US006138295A

United States Patent [19]

Hess

[11] Patent Number: 6,138,295

[45] **Date of Patent: *Oct. 31, 2000**

[54] BATHTUB IMPROVEMENTS

[75] Inventor: Stephen W. Hess, Apple Vally, Calif.

[73] Assignee: McHess Enterprises, Inc.,, Adelanto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/039,661

[22] Filed: Mar. 16, 1998

[51] Int. Cl.[7] ..... A47K 3/08

[52] U.S. Cl. ..... 4/558; 4/559; 4/608

[58] Field of Search ..... 4/538, 558, 590, 4/609, 559, 584, 608; D23/277, 280.1, 275; 52/35

[56] References Cited

U.S. PATENT DOCUMENTS

| | | | |
|---|---|---|---|
| D. 95,376 | 4/1935 | Morgan | D23/280.1 |
| D. 148,393 | 1/1948 | Schladermundt et al. | 4/538 X |
| D. 226,852 | 5/1973 | Korol | D23/275 |
| D. 227,468 | 6/1973 | Seymour | D23/280.1 |
| 824,454 | 6/1906 | Vanderman | 4/558 X |
| 1,807,107 | 5/1931 | Sternbergh | 4/609 X |
| 2,122,247 | 6/1938 | Coordes | 4/590 |

*Primary Examiner*—Robert M. Fetsuga

*Attorney, Agent, or Firm*—Myers, Dawes & Andras LLP

[57] ABSTRACT

There is disclosed a bathtub having interior front end corners between the walls being smoothly curved with a large radius of curvature, about 6 inches, and having pockets recessed into the corners between the front wall and opposite end walls to receive the bottom ends of a shower curtain, thereby permitting the opposite side edges of the shower curtain to be in contact with their respective shower wall substantially the entire vertical length of the curtain. This avoids gaps between the shower walls and the bottom corner ends of the shower curtain through which water can escape from the shower enclosure.

9 Claims, 3 Drawing Sheets

BATHTUB IMPROVEMENTS

BACKGROUND OF THE INVENTION

1. Field of the Invention

This invention relates to bathtubs, and particular, to bathtubs for use with shower curtains.

2. Brief Description of the Prior Art

The conventional bathtub intended for installation in a shower enclosure is formed with a interior bathing recess having back and front walls and dry and wet end walls, the latter being located at the drain end of the tub. The interior side and end walls are joined with smooth curvatures of large radii, generally at least about six inches to provide stress relief, ease of cleaning and maintenance and for a pleasing aesthetic appearance.

The conventional tubs have an essentially planar top surface which has a flat ledge along the back side wall and the wet endwall. The front of the tub is usually provided with a front skirt and also has a flat ledge, often referred to as a "bench" along the entire front.

Nailing flanges are usually provided along the back wall and the dry and wet endwalls to secure the tub to the dwelling frame members and the shower enclosure walls are applied over these flanges after installation of the tub.

The conventional shape of bathtubs when used in a shower enclosure presents a persistent problem caused by an inadequate containment of the bottom of a shower curtain. In particular, the smooth curvatures of large radii between the interior endwalls and the front wall prevent the lower end of the shower curtain from hanging next to the shower walls, forming gaps at each end of the tub through which overspray or splash from the shower invariably escapes onto the bathroom floor in front of the bathtub. The resultant wet floor causes slip and fall injuries and structural damage such as loosening of floor tiles or other floor coverings, dry-rot and termite damage, all requiring increased maintenance. This ubiquitous problem has been unsolved for the many generations of use of bathtubs in tub and shower enclosures.

OBJECTIVES OF THE INVENTION

It is an objective of this invention to provide a bathtub with endwall accommodations for shower curtains and the like.

It is a further objectives of this invention to provide recessed pockets in the top surface of a bathtub.

It is an additional objective of this invention to provide a recessed pocket in each of the two front interior corners of a bathtub, thereby providing storage spaces, in addition to accommodating for the ends of the shower curtain.

Other and related objectives will be apparent from the following description of the invention.

BRIEF STATEMENT OF THE INVENTION

This invention comprises a bathtub having a pocket recessed from its upper surface in each of the curved corners between its interior front wall and opposite end walls. The pockets receive opposite edges of the bottom end of the shower curtain, permitting the opposite edges of the shower curtain to remain in contact with the shower walls along the entire length of the curtain, thereby avoiding gaps between the bottom of the curtain and the shower walls.

BRIEF DESCRIPTION OF THE DRAWINGS

The invention will be illustrated by the figures of which.

DESCRIPTION OF PREFERRED EMBODIMENTS

Figure 1:
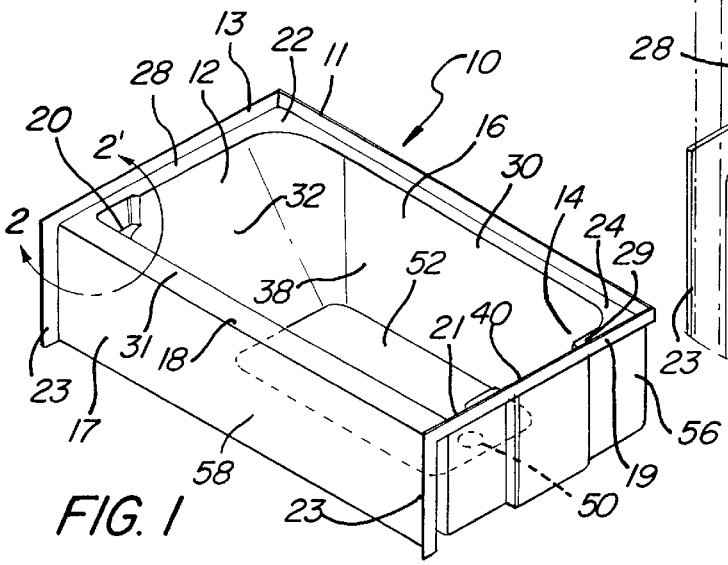
FIG. 1 illustrates a bathtub with the improved recessed pockets of my invention.

Referring to FIG. 1, there is illustrated a bathtub 10 which has conventional, interior, dry end wall 12, wet end wall 14, back wall 16 and front wall 17. The dry end wall 12 and back wall 16 and front wall 17 are usually inclined inwardly towards the interior bottom surface 52. The tub has a generally planar top with flat, horizontal ledges which surround the bathing recess, such as the dry end ledge 28, the back ledge 30, the wet end ledge 29 and the front ledge, or bench 18. As with conventional tubs, the inside corners between the interior end walls and the back and front walls are smoothly curved with radii of curvatures in excess of about six inches to provide stress relief, ease of cleaning and maintenance and for a pleasing aesthetic appearance. Nailing flanges are provided along the ends and back of the tub such as vertical dry end flange 13, back flange 11 and wet end flange 19. The front skirt 58 of the tub 10 also has nailing flanges 23 at each end. These flanges are used to secure the tub to framing members of the building in which the tub is installed and to provide flashing which extends underneath the walls of the shower enclosure.

Figure 2:
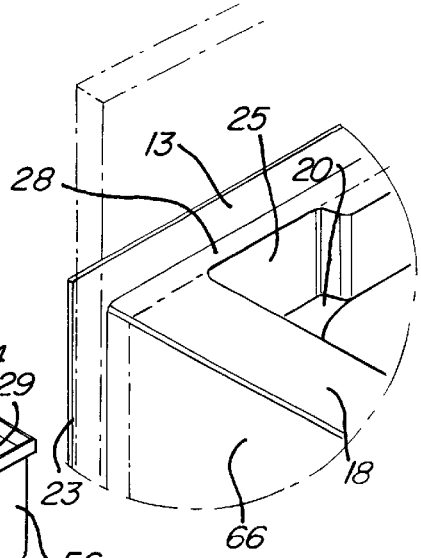
FIG. 2 is an enlarged view of the area within line 2-2' of FIG. 1 illustrating one of the recessed pockets of my invention and the flush feature of the pocket with a shower wall.

The tub of this invention is provided with pockets 20 and 21 at the interior corners of the tub between the front wall 17 and wet end wall 14 and dry end wall 12. The pockets 20 and 21 are formed with interior corners with lesser radii of curvature than that of the interior corners 22 and 24 of the tub 10 (see FIG. 2). The end wall 25 of the pocket is located so that it will be at a substantially flush position with the shower wall, which will be installed over the nailing flange as shown in FIG. 2. The same configuration is provided for the pocket 21 at the wet end of the tub 10. The pockets are open to the bathing cavity of the tub and extend downwardly from the top (ledges 28 and 29 and bench 18) of the tub a distance from about 1 to 6 inches, preferably 3.5 inches.

The tub 10 also has a central recess 40, which is optional, in its interior wet end wall 14. The central recess 40 provides for the installation of conventional bathtub plumbing fixtures such as an overflow. The remainder of the tub is conventional with a drain 50 in the bottom surface 52 and with the interior end walls 12 and 14, back wall 16 and front wall 17 being inclined downwardly and inwardly towards the flat bottom surface 52.

Figure 3:
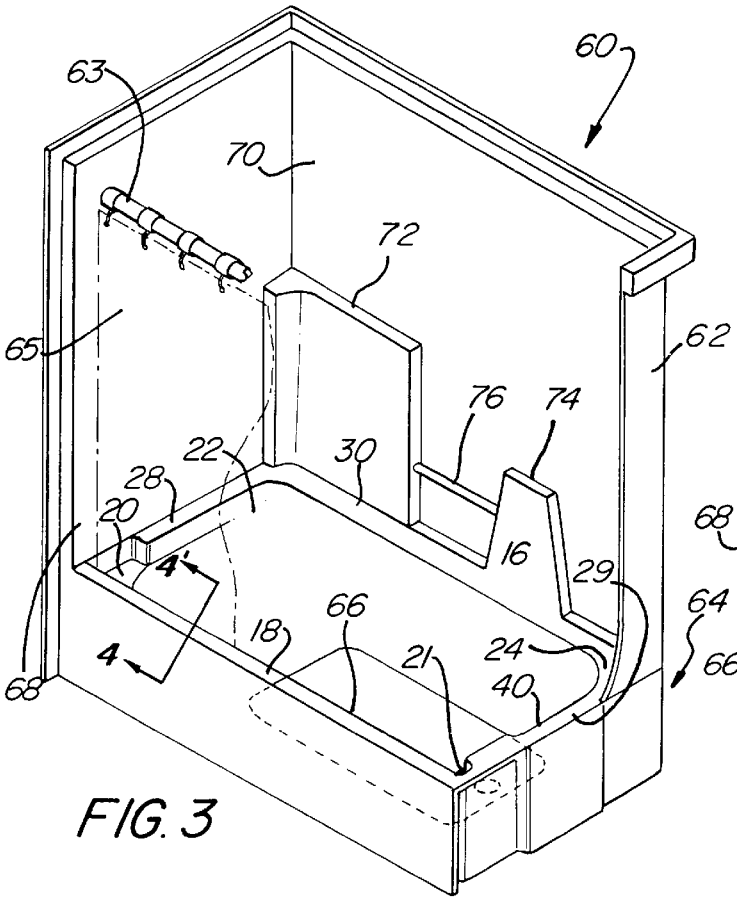
FIG. 3 illustrates a unitary tub and shower enclosure of my invention with a portion of a shower curtain shown in phantom lines.

Referring now to FIG. 3, there is illustrated an integral, molded tub and shower enclosure 60 in which a portion of the front endwall 62 of the shower enclosure has been cut away for illustration purposes. FIG. 3 also illustrates the shower curtain rod 63 and a portion of a shower curtain 65 (in phantom lines), illustrating that the curtain can be moved into close conformity with the endwalls of the enclosure.

As illustrated, the bathing cavity of the tub portion 64 of the shower enclosure 60 has the same shape as that illustrated in FIG. 1, however, as with conventional tub shower enclosures, the endwalls 68 and 62 and inside back wall 70 extend upwardly for a substantial distance, typically six feet to provide the shower surround. Also as conventional in such installations, the inside back wall is provided with inset portions 72 and 74 that extend partially up the wall to permit installation of a grab bar 76.

As with the bathtub as described in FIG. 1, this tub shower enclosure is provided with recessed pockets 20 and 21 at the opposite ends of its interior front wall 66. These pockets are recessed from one to six, preferably three and one-half, inches beneath the planar top ledges 28, 29 and 30 and bench 18 of the tub. The opposite corners 22 and 24 at the back wall 16 of the tub are smoothly contoured with the end walls at conventional radii of curvature, typically in excess of six inches. As with the tub of FIG. 1, the wet end wall of the tub has a central recess 40.

Figure 4:
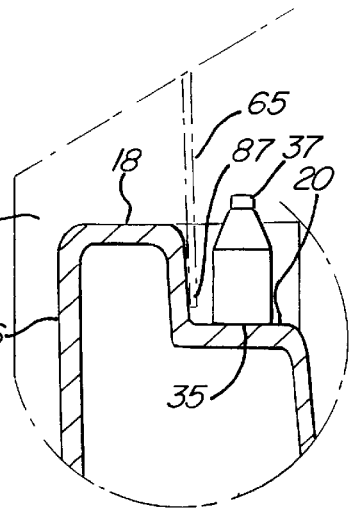
FIG. 4 is an enlarged view of the area within line 4-4' of FIG. 3.

The pockets receive the bottom end 87 of the shower curtain 65, which hangs freely within the pockets; see FIG. 4 which illustrates the dry end pocket 20. The pockets can be formed with flat, i.e., horizontal bottom surfaces 35 to provide storage for items such as shampoo bottles 37, etc.

Figure 5:
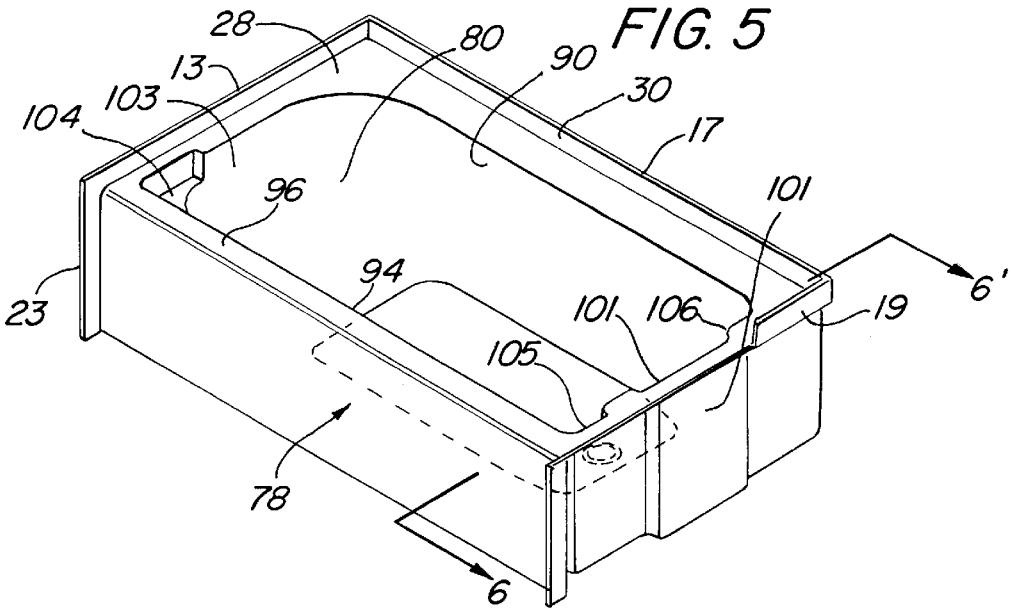
FIG. 5 illustrates an embodiment of my invention in which pockets are recessed into the interior corners at opposite ends of the front wall of a tub.
Figure 6:
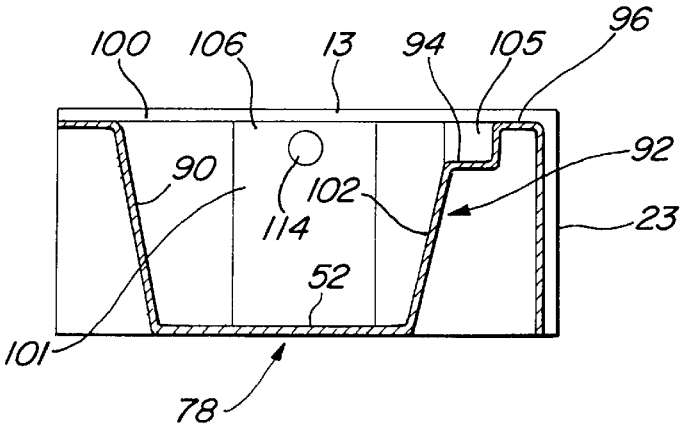
FIG. 6 is a sectional view along lines 6-6' of FIG. 5.
Figure 7:
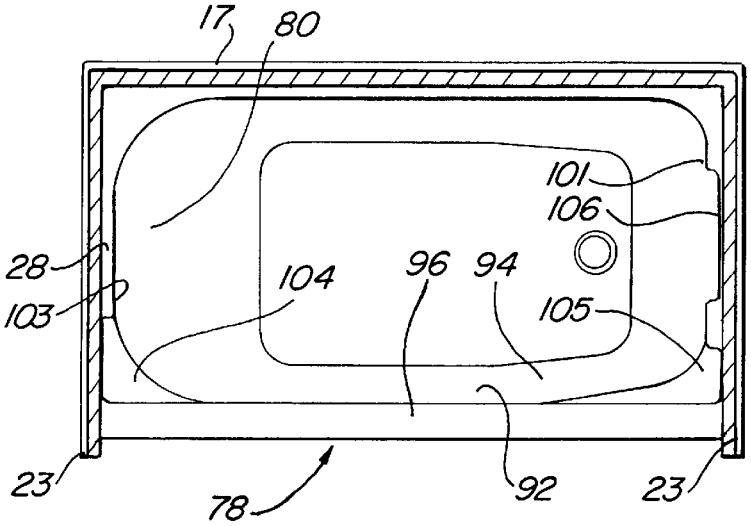
FIG. 7 is a top view of the tub shown in FIGS. 5 and 6.

Referring now to FIGS. 5–7, there is illustrated an embodiment of the invention which has inclined walls, but, like FIG. 1, has a narrow dry end ledge 28. FIG. 6 is a sectional view taken along lines 6-6' of FIG. 5. As illustrated in FIGS. 5–7, the tub 78 has an inclined dry end wall 80 and inclined interior front wall 92 and back wall 90 (see FIG. 6). The interior wet end wall 106 of the tub 78 which is shown in FIG. 6 has a central recess 101 with a conventional overflow 114. The location of this element is undisturbed from the conventional location.

In FIG. 7, pockets 104 and 105 are recessed into the front interior wall 92 a distance from 1 to 6, preferably 3.5, inches beneath the planar top bench 96 of the tub 78. The pocket 105 at the wet end of the tub is also recessed into the wet end wall 106 of the tub so that the end wall of the pocket 105 will be substantially flush with a shower wall installed over the nailing flange 19 as shown in FIG. 7. As a portion of the dry end ledge 28 is narrow and not significantly greater than the thickness of a shower wall, pocket 104 extends to a flush position with the inside edge 103 of ledge 28, the inside ledge 103 thereby being located at a substantially flush position to a shower wall installed over nailing flange 13. The pockets 104 and 105 at each end thereof, and the unobstructed pathway extending in between the pockets 104, 105 as shown accommodate the opposite edges at the bottom of a shower curtain, permitting the shower curtain to hang freely, from wall to wall and pocket to pocket with its opposite side edges remaining against the shower end walls the entire length of the curtain, thereby avoiding any gaps in coverage of the shower opening.

Figure 8:
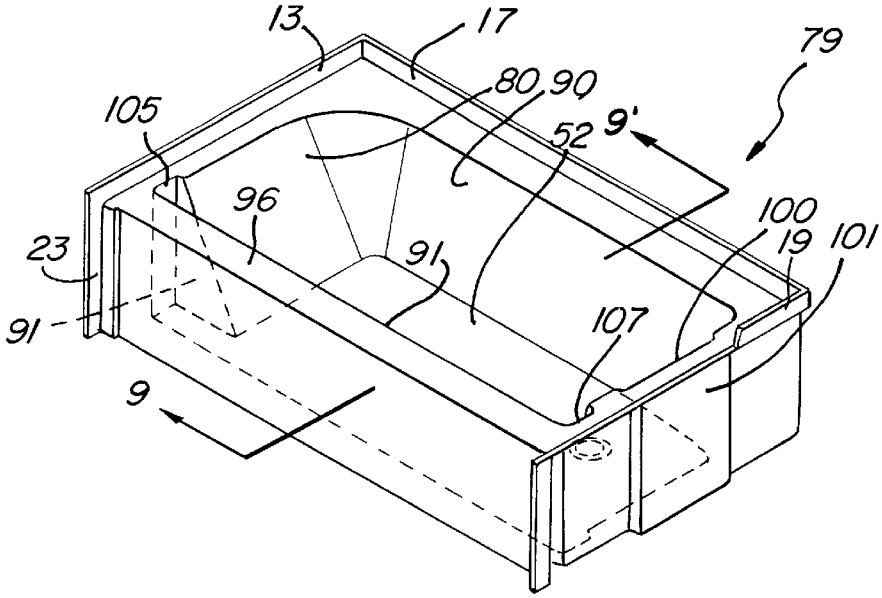
FIG. 8 illustrates another embodiment of my invention in which the internal front wall of the tub is flush with the upper front edge of the tub.
Figure 9:
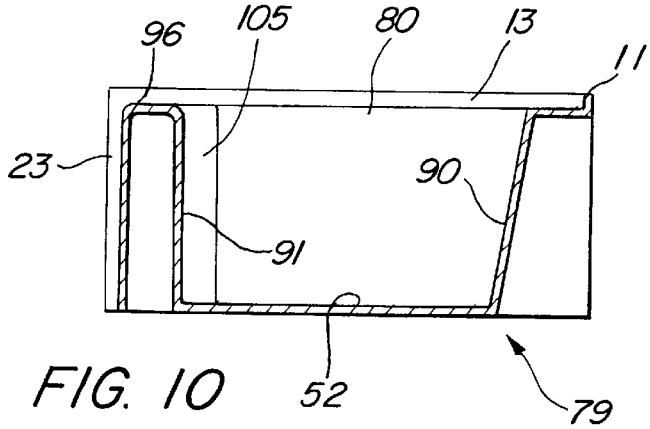
FIG. 9 is a sectional view along lines 9-9' of FIG. 8.
Figure 10:
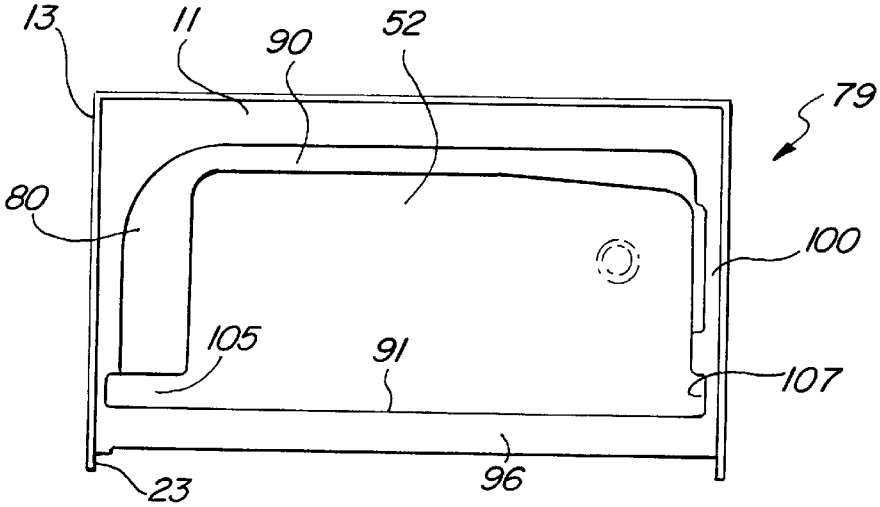
FIG. 10 is a top view of the tub shown in FIGS. 8 and 9.

Referring now to FIGS. 8–10, there is illustrated another embodiment in which the interior front wall 91 of the tub is substantially vertical. The tub 79 has a more or less conventional curved interior back wall 90, however, the interior front wall 91 is flush with the inside edge of the upper top surface 96; see FIG. 9. Pocket 105 at the dry end of the tub and pocket 107 at the wet end of the tub extend downwardly to the bottom surface 52 of the tub 79.

In other respects, the tub 79 is substantially similar to tub 78 shown in FIGS. 5–7, and both embodiments provide adequate accommodation for a shower curtain, permitting the lower end of the shower curtain to move into close conformity to the vertical endwalls of the enclosure in which the tubs are seated.

While the invention is of particular value in commercial installations such as motels and hotels, it also offers significant advantages for residential use, particularly in residences with wood floors and support structures which are subject to dry rot and termite damage.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In a bathtub to be installed in a shower enclosure having a back shower wall, a dry end shower wall, and a wet end shower wall, said bathtub having interior front, back, wet end, dry end and bottom walls defining an interior bath cavity, said cavity having smoothly rounded corners with a radius of curvature no less than about six inches between said front and end walls, the improvement comprising:

a first curtain pocket open to said bathing cavity which is recessed in a first corner between said front wall and said wet end wall of said tub, said first pocket having a first interior pocket end wall which is substantially flush with said wet end shower wall;

a wet end horizontal ledge including a portion adjacent to the first curtain pocket that has a thickness substantially similar to a thickness of said wet end shower wall;

a second curtain pocket open to said bathing cavity which is recessed in a second corner between said front wall and said dry end wall of said tub, said second pocket having a second interior pocket end wall which is substantially flush with said dry end shower wall; and a dry end horizontal ledge including a portion adjacent to the second curtain pocket that has a thickness substantially similar to a thickness of said dry end shower wall.

2. The bathtub of claim 1 wherein said first curtain pocket extends beneath said wet end ledge a distance from about 1 to 6 inches and said second curtain pocket extends beneath said dry end ledge a distance from about 1 to 6 inches.

3. The bathtub of claim 1 further comprising a front skirt extending along an exterior front wall of said bathtub.

4. The bathtub of claim 1 wherein a substantially unobstructed pathway lies between said first and second pocket.

5. A shower enclosure and tub which comprises:

a. a tub having an interior bathing cavity defined by front and back interior tub walls, wet and dry end interior tub walls and a bottom tub wall;

b. vertical wet end and dry end shower walls coextensive with said wet and dry end tub walls, respectively, and a vertical back shower wall coextensive with said back tub wall, each of said shower walls being offset from it respective tub wall to provide wet and dry end ledges and a back ledge;

c. a shower curtain rod extending between said wet and dry end shower walls above and coextensive with said front tub wall with a shower curtain having its upper end attached to said curtain rod and freely hanging therefrom with its lower end received in, and unattached to, said tub;

d. first and second front-side curtain pockets, each curtain pocket having a side opening and a top opening, said side openings open to said bathing cavity and facing each other without obstruction, said curtain pockets recessed into each of said wet and dry end ledges adjacent said front tub wall at a curtain portion of said ledges, an end wall of each curtain pocket being substantially flush with its respective shower wall, said top openings of said curtain pockets being located vertically beneath said curtain rod to receive the unattached lower end of said shower curtain, said shower curtain hanging downward from said shower curtain rod and into said top openings of said curtain pockets and freely along the front interior tub wall between said end walls of said first and second pockets and said respective end shower walls that are substantially flush with said curtain pocket end walls, whereby the sides of said shower curtain remain in contact with said shower walls.

6. The shower enclosure and tub of claim 5 wherein said first and second curtain pockets extend vertically a distance from 1 to 6 inches below said ledges.

7. The shower enclosure and tub of claim 5 formed as an integral, one-piece tub and shower enclosure.

8. The shower enclosure and tub of claim 5 wherein said tub is a component in combination with said shower enclosure.

9. The shower enclosure and tub of claim 5 wherein said tub includes an unobstructed top ledge coextensive said front wall.

* * * * *